US007229204B2

(12) United States Patent
Haskell

(10) Patent No.: US 7,229,204 B2
(45) Date of Patent: Jun. 12, 2007

(54) PORTABLE MIXING APPARATUS

(76) Inventor: George L. Haskell, 4715 Road 7.5, NE., Moses Lake, WA (US) 98837

( * ) Notice: Subject to any disclaimer, the term of this patent is extended or adjusted under 35 U.S.C. 154(b) by 341 days.

(21) Appl. No.: 10/911,827

(22) Filed: Aug. 4, 2004

(65) Prior Publication Data

US 2006/0028913 A1 Feb. 9, 2006

(51) Int. Cl.
*B01F 9/08* (2006.01)

(52) U.S. Cl. ..... 366/56; 366/224; 366/233

(58) Field of Classification Search ..... 366/46–48, 366/53–63, 92–95, 197, 200, 201, 204, 219–236, 366/605

See application file for complete search history.

(56) References Cited

U.S. PATENT DOCUMENTS

| | | | | |
|---|---|---|---|---|
| 2,494,119 | A | 1/1950 | Essick | |
| 2,573,296 | A | 10/1951 | Arant | |
| 2,597,291 | A * | 5/1952 | Clegg | 366/208 |
| 2,838,291 | A | 6/1958 | Peebles | |
| 3,424,440 | A | 1/1969 | Upham et al. | |
| 3,768,785 | A | 10/1973 | Susemihl | |
| 4,042,222 | A | 8/1977 | Clement | |
| 4,078,263 | A * | 3/1978 | Campbell | 366/53 |
| 4,197,015 | A | 4/1980 | Moser et al. | |
| 4,223,997 | A | 9/1980 | Violet et al. | |
| 4,277,185 | A * | 7/1981 | Thompson | 366/213 |
| 4,294,548 | A | 10/1981 | Watson | |
| 4,332,482 | A * | 6/1982 | Engler | 366/130 |
| 4,357,109 | A | 11/1982 | Blakeway | |
| 4,435,082 | A | 3/1984 | Bishop | |
| 4,491,415 | A | 1/1985 | Bishop | |
| 4,501,499 | A * | 2/1985 | Boan et al. | 366/156.1 |
| 4,521,116 | A | 6/1985 | Adsit | |
| 4,634,284 | A | 1/1987 | Bishop | |
| 4,750,840 | A | 6/1988 | Bishop | |
| 5,118,198 | A | 6/1992 | Whiteman, Jr. | |

(Continued)

FOREIGN PATENT DOCUMENTS

GB 1574303 * 9/1980

(Continued)

*Primary Examiner*—Charles E. Cooley
(74) *Attorney, Agent, or Firm*—Todd N. Hathaway

(57) ABSTRACT

A portable mixing apparatus that employs disposable 5-gallon plastic buckets as containers for mixing mortar, grout, plaster and other materials. First and second motor-driven rollers support the buckets at a downwardly sloped angle. A separate mixing basket is placed within the buckets, and includes a plurality of blades that pass through the material as the bucket is rotated by the rollers. The leading roller is positioned lower than the trailing roller so as to engage the flexible wall of the bucket in an area where it is subject to outward pressure from the material during rotation. The rollers are provided with ribbed, non-slip covers having channels that accommodate water and debris on the exteriors of the buckets. The mixing basket is formed of a plurality of coaxial, longitudinally-spaced rings joined at their edges by longitudinal rods. The blades are mounted internal to the rings and extend generally parallel to the axis of the buckets, with the ends of the rods being angled in the direction of rotation. The drive rollers and motor are mounted in a frame having folding legs so that the assembly can be collapsed to a compact form for transportation or storage.

24 Claims, 5 Drawing Sheets

U.S. PATENT DOCUMENTS 5,302,017 A 4/1994 Platek et al.
5,492,401 A 2/1996 Halsted
5,816,702 A * 10/1998 Mays et al. ..... 366/228
5,868,494 A 2/1999 Campbell et al.
5,934,800 A 8/1999 Bonacci
6,220,744 B1 4/2001 Blackhurst
6,450,681 B1 * 9/2002 Nettelhoff et al. ..... 366/348
2003/0085234 A1 * 5/2003 Paumen et al. ..... 220/912
2006/0028913 A1 * 2/2006 Haskell ..... 366/224

FOREIGN PATENT DOCUMENTS

JP 3-238033 * 10/1991

* cited by examiner

PORTABLE MIXING APPARATUS

BACKGROUND OF THE INVENTION a. Field of the Invention

The present invention relates generally to an apparatus for mixing mortar, cement, and similar materials, and, more particularly, to a portable mixer for preparing such materials in ordinary disposable plastic buckets.

b. Related Art

Certain materials and compositions require mixing prior to use, particular examples of such materials being grout, mortar, plaster and cement. For example, masonry work or tile work typically requires that the mortar or grout be mixed at the jobsite immediately before use.

Unlike concrete, which is typically obtained in large volumes from a ready-mix plant or a mixer truck, mortar and grout work employ fairly small batches of material. For example, a brick mason or tile setter will typically prepare a small batch or mortar or grout for work at a first job site and then move to another job site and prepare another batch of material, as, for example, when moving from one house to another in a subdivision that is under construction.

Consequently, both portability and the ability to prepare small batches of material quickly and efficiently are important factors. Cost is also a significant important factor, particularly since many or most brick masons and tile setters are independent professionals who must buy all of their own equipment.

Currently available mixers do not adequately satisfy the foregoing criteria. Mortar or grout can, of course, be mixed the "old fashioned" way simply using a bucket and trowel, however this is neither convenient nor efficient, except for very small amounts of material. On the other hand, existing motor-driven mixers are expensive and lack adequate portability. For example, conventional mixers typically employ comparatively large steel or plastic drums that are rotated by an attached drive. Not only are the mixers themselves bulky and difficult to transport they are also cumbersome to use, since the drum must be dumped out into a smaller, second container (such as a bucket or tray) from which the mortar/grout is then applied. Moreover, the entire drum must be rinsed out and cleaned between jobs, lest it become encrusted with hardened material.

Another category of mortar/grout mixing devices employ rotating blades that are mounted on the end of a long shaft and driven by an electric motor, somewhat resembling an outsized paint mixer driven by an electric drill. These are inserted into tubs so as to generate a stirring action that mixes the components. In practice, however, this class of devices is highly unsatisfactory for several reasons, including inadequate mixing of the materials and the messy, cumbersome and physically tiring action that is inherent in their operation; moreover, the fact that they are manually operated means that other work must be stopped while the mortar/grout is being mixed. Another existing device resembles a small "roto-tiller" that mixes the material in a plastic trough, which combines the drawbacks of the "electric drill" type mixers with the cost, portability and cleaning problems associated with drum mixers.

Accordingly, there exists a need for an apparatus for mixing mortar, grout, and similar materials that is portable and readily transportable for going from one job site to the next. Furthermore, there is a need for such an apparatus that is convenient and easy to operate, yet which provides thorough mixing of the material. Still further, there is a need for such an apparatus that does not require the mortar, grout or other mixed material to be pumped into a separate container for use. Still further, there exists a need for such an apparatus that is inexpensive, requires minimal maintenance, and is long lasting in use.

SUMMARY OF THE INVENTION

The present invention has solved the problems cited above, and is a compact, easily transportable mixing apparatus that employs disposable 5-gallon plastic buckets as the containers for mixing mortar, grout, plaster and other materials.

Broadly, the apparatus comprises: (a) a drive assembly having (i) first and second generally parallel drive rollers that are spaced apart so as to form a cradle area for receiving the side of a plastic bucket therein, and (ii) means for rotating at least one of the drive rollers so as to rotate the plastic bucket when the bucket is in engagement therewith, and (b) a mixing basket for being placed within the interior of the plastic bucket, the mixing basket being free from attachment to the bucket and having at least one mixing blade for agitating the material in the bucket as the bucket is rotated by the drive rollers.

The drive assembly may comprise means for rotating both the first and second drive rollers. The means for rotating the drive rollers may comprise a motor and power transmission means operatively interconnecting the motor and drive rollers. The power transmission means may comprise a drive chain in engagement with a drive sprocket on an output shaft of the motor and driven sprockets on the first and second drive rollers.

The drive assembly may comprise means for supporting the first and second drive rollers at a downwardly and rearwardly sloping angle, so that the bucket is supported at an angle which slopes towards its lower end when resting on the rollers. The assembly may further comprise means for engaging and supporting a peripheral lip around the bottom of the bucket so as to maintain the sloping bucket in a predetermined longitudinal position on the rollers. The means for supporting the rollers in a downwardly and rearwardly sloping angle may comprise a frame having at least forward and rearward legs mounted thereto, the forward leg being relatively longer than the rearward leg so that the frame is supported at the downwardly and rearwardly sloping angle.

The leading drive roller may be positioned relatively lower than the trailing drive roller, so as to bear against the sidewall of the bucket in areas that are subject to increased outward pressure during rotation of the bucket with the material that is being mixed therein. The first and second generally parallel drive rollers may be angled together towards the rearward ends thereof, so as to extend at an angle that matches a predetermined taper of the sidewall of the bucket.

The drive rollers may comprise non-slip external surfaces for frictionally engaging the sidewall of the plastic bucket in drive relationship therewith. The non-slip surfaces may comprise resiliently compressible sleeves mounted externally on the first and second drive rollers. The resiliently compressible sleeves may comprise a plurality of raised ridges for engaging the sidewall of the bucket, with channels being formed between the ridges for receiving water and debris as the bucket is rotated in contact therewith.

The basket assembly may comprise an open framework having a plurality of blade members mounted thereto. The blade members may comprise upper and lower blade members that are mounted to the framework in diametrically opposed pairs. The blade members may extend generally longitudinally on the framework, and the ends of the blade members may be bent forwardly in the direction of rotation of the plastic bucket.

The framework may comprise a plurality of rings having the blade members mounted internally thereto. The rings may be progressively smaller from top to bottom so as to define a taper that corresponds to the taper of the sidewall of the bucket. The rings of the basket assembly may be sized to form an annular gap of about ½-inch with the sidewall of the bucket when centered therein.

The framework of the basket assembly may further comprise a plurality of longitudinally extending rods. The rods may comprise upper ends that are bent to form handle portions for manually lifting the basket assembly. The longitudinal members may also comprise downwardly extending strut portions for supporting the bottom end of the framework a spaced distance above the floor of the bucket. The basket assembly may be constructed of welded metal rod.

These and other features and advantages of the present invention will be apparent from a reading of the following detailed description with reference to the accompanying drawings.

DETAILED DESCRIPTION a. Overview

As noted above, the present invention provides an apparatus by which mortar, grout, plaster and similar materials are be mixed on the jobsite in one or more ordinary 5-gallon plastic buckets. The apparatus is inexpensive, efficient and highly portable.

Figure 1:
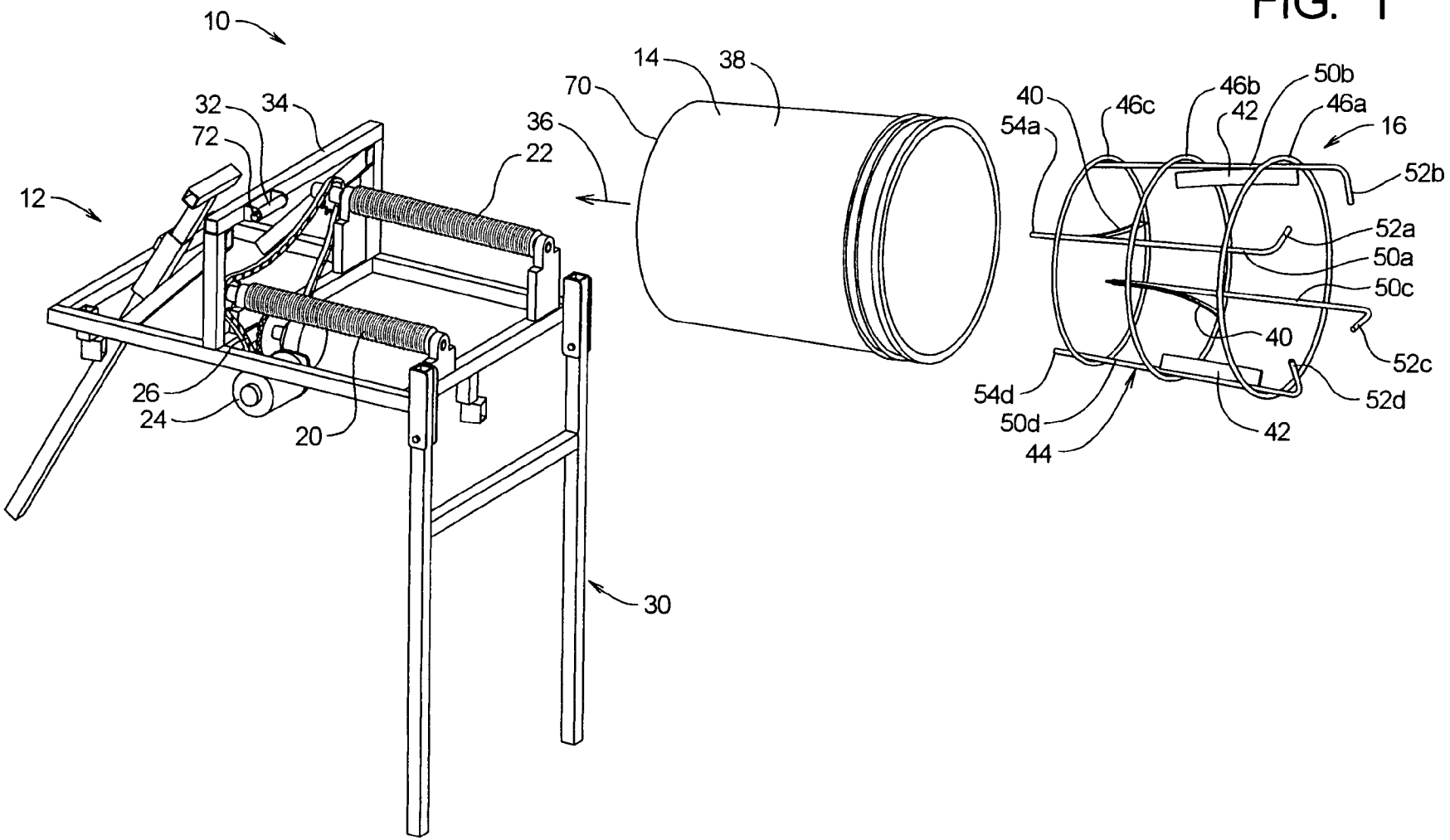
FIG. 1 is a perspective view of a portable mixing apparatus in accordance with the present invention, showing the manner in which a standard 5-gallon plastic bucket is placed on the drive assembly and the separate mixer basket of the present invention is then placed in the bucket so as to mix the mortar, grout or other contents thereof.

As can be seen in FIG. 1, the apparatus 10 of the present invention includes two primary subassemblies, i.e., a drive assembly 12 that rotates the plastic bucket 14, and a multi-bladed mixer basket 16 that is placed within the interior of the bucket.

The bucket 14 is an ordinary 5-gallon plastic bucket, such as are used in large quantities as containers for many different types of products, in the food and construction industries and elsewhere; for example, 5-gallon buckets are commonly employed as containers for paint. The popularity of 5-gallon buckets is due in large part to the fact that this is a particularly convenient size for handling most fluid or semi-fluid materials, which makes them likewise advantageous for handling the grout, mortar and other materials with which the present invention is concerned.

Typically, the buckets are formed of a molded high-density polyethylene material that is generally rigid but has a moderate degree of flexibility, and the majority include a bale or other form of handle for carrying purposes. Although 5-gallon buckets can be purchased new—singly or in numbers—they are most frequently available as a used item, after the contents have been emptied for their original purpose. The buckets are consequently extremely inexpensive, to the point of being disposable; they are, however, tough and durable, and are also very easily cleaned due to the smooth, low-adhesion surface of the molded polyethylene material.

The conventional 5-gallon plastic bucket therefore represents an optimal container for transporting and handling cement grout, mortar, and similar materials at a job site. Moreover it can be obtained for little or no cost. Consequently, by virtue of its ubiquitous and disposable nature, the 5-gallon bucket 14 may not be supplied as part of the mixing apparatus per se, but may instead be obtained from other sources, e.g., as an empty container collected from other construction activities.

The principle function of the drive assembly 12 is to rotate the plastic bucket while supporting it at an optimal angle for mixing purposes. As can be seen, the drive assembly includes leading and trailing drive rollers 20, 22 that are rotated by a drive motor 24 via a drive chain 26. The drive rollers extend somewhat parallel to one another and are spaced apart so as to form something of a "cradle" for receiving and retaining the bucket 14. The rollers are supported at a sloped angle by a collapsible stand 30, so that the bucket 14 will be supported thereon lying on its side and sloping downwardly towards its closed bottom. An idler roller 32, mounted on a raised crossbar 34, engages the annular, depending rim around the bottom of the bucket so as to act as a stop that maintains the bucket in the proper longitudinal position relative to the drive rollers.

When the bucket is placed on the drive assembly 12, as indicated by arrow 36, the rollers 20, 22 contact the generally cylindrical, somewhat tapered sidewall 36 of the bucket, with the weight of the material in the bucket forcing the rollers into frictional engagement therewith. Effective drive engagement is ensured by resilient, tubular sheaths on the rollers that increase the frictional engagement with the exterior of the plastic bucket, as will be described in greater detail below.

The basket assembly 16 is a separate structure that is configured to be removably placed within the interior of the bucket 14. The basket assembly includes a plurality of blade members that are mounted to an open framework; in the illustrated embodiment, the basket assembly includes generally longitudinally extending upper and lower blades 40, 42 that are mounted in opposing pairs to a wire frame 44. As will be described in greater detail below, the wire frame is formed by a series of longitudinally-spaced wire rings 46*a*, 46*b*, 46*c* that extend around a common axis but are progressively smaller towards the lower end of the assembly, so as to follow a taper that corresponds to the taper of the sidewall 38 of the bucket. The rings are joined by longitudinal wire rods 50*a*, 50*b* having upper ends that are bent to form handle portions 52*a*, 52*b* for lifting the basket assembly when removing it from the bucket; the lower ends, in turn, project below the lowermost ring 46*c* to form struts 54*a*, 54*b* that space the lowermost ring and blades above the floor of the bucket.

As will be described in greater detail below, the blade members of the basket assembly are mounted internal to the wire rings 46*a–c*, and the rings are sized somewhat smaller than internal diameter of the bucket of each corresponding location so that a gap having a predetermined size is formed between the wall of the bucket and the exterior of the basket assembly. This allows the basket assembly to rotate relative to and free of the plastic bucket as the latter is rotated by the drive rollers, so that the basket rolls with the bucket but at a slightly different speed.

When the desired degree of mixing has been accomplished, the bucket is removed from the drive assembly. The basket assembly is then withdrawn and inserted in a second bucket, together with the next batch of material to be mixed. The second bucket is then placed on the drive assembly to commence mixing, while the first bucket is carried to the application site. In this manner mixing can continue in an almost continuous manner without requiring the attention of the operator.

b. Drive Assembly

Figure 2:
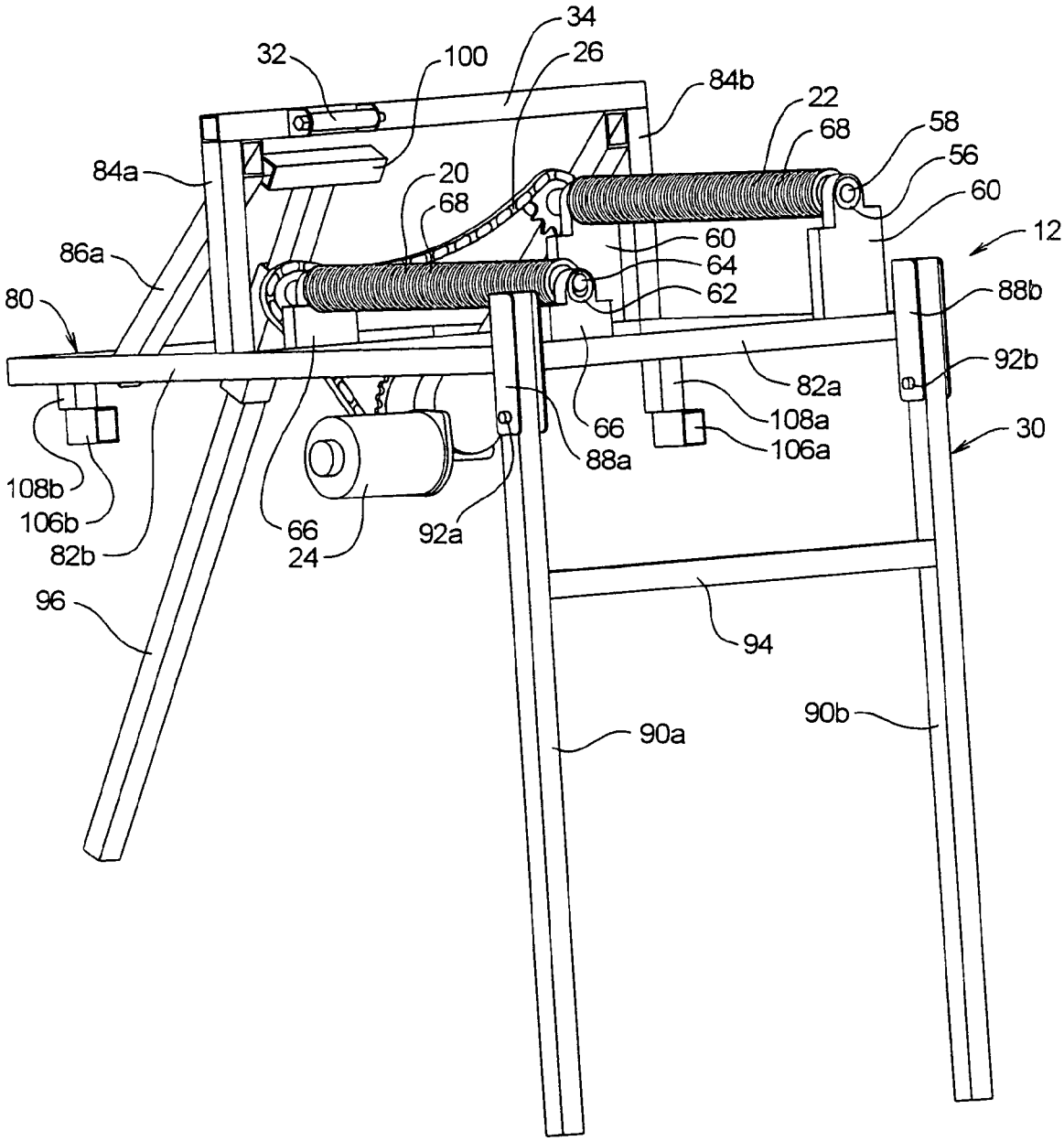
FIG. 2 is a front, perspective view of the drive assembly of the mixer apparatus of the present invention, showing the arrangement of the drive rollers and their supports in greater detail.
Figure 3:
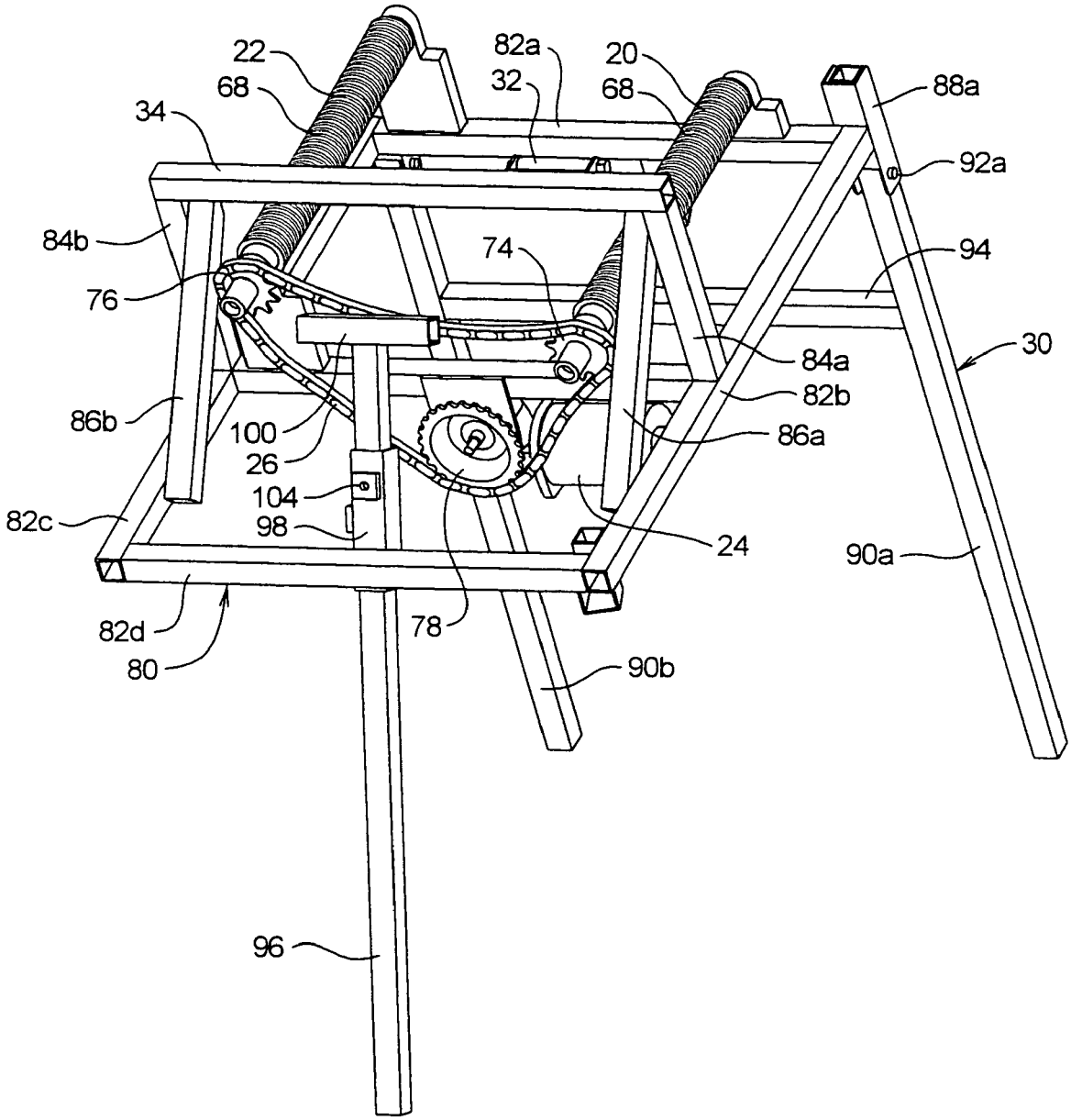
FIG. 3 is a rear, perspective view of the drive assembly of the mixer apparatus of FIGS. 1–2, showing the roller drive mechanism in greater detail.

The structure of the drive assembly 12 is shown in greater detail in FIGS. 2–3.

As noted above, the drive rollers 20, 22 extend generally parallel to the cylindrical axis of the plastic bucket when the latter is placed thereon. However, rather than being precisely parallel, the drive rollers are angled together slightly towards their rearward ends, at an angle that corresponds to the taper of the plastic bucket so that the rollers make contact with the outer wall of the bucket over substantially the entirety of their lengths; most plastic buckets have a substantially identical taper, and the slightly yielding, flexible nature of the polyethylene material enables the wall of the bucket to flex slightly so as to accommodate any minor differences between the taper and the angle of the rollers 20, 22. In the preferred embodiment that is illustrated, the drive roller shafts are approximately 10½-inches long and spaced approximately 9½-inches center-to-center with an approximate 1/16-inch taper, i.e., the rollers are 1/16-inch closer together at the rear than at the front.

As can also be seen in FIGS. 2–3, the drive rollers have a "stepped" relationship, with the leading drive roller 20 being positioned significantly lower than the trailing drive roller 22. This is accomplished by mounting the bearings 56 for the shaft 58 of the trailing roller in pillow blocks atop raised pedestal brackets 60, while the bearings 62 for the shaft 64 of the leading drive roller are supported by pillow blocks atop relatively shorter pedestal brackets 66. The height difference is preferably about 2-inches or just slightly more; in the illustrated embodiment, the brackets 66 for the leading roller are only 1⅜-inches tall and those for the trailing roller are 3½-inches tall, giving a height difference of 2⅛-inch. Again, this has been found to give optimal performance, with the flexibility of the polyethylene or other plastic material allowing the drive mechanism to accommodate buckets having slightly different configurations.

The difference in height between the leading and trailing drive rollers ensures maximum stability and frictional engagement between the rollers and bucket during the mixing operation. During rotation of the bucket (which is in the counter-clockwise direction when viewed from the front, in the embodiment that is illustrated in the figures), the somewhat cohesive, pasty consistency of the grout, mortar and similar materials will cause the material to tend to climb up the trailing side of the bucket and then fall away across the interior of the bucket, so that the material typically falls back into contact with the wall of the bucket at about the 8 o'clock–7 o'clock position (assuming counter-clockwise rotation). The leading drive roller 20 is therefore located where it will bear against the outside of the wall of the bucket in the area where the inner surface of the wall will be receiving the impact/momentum of the falling material. The trailing drive roller 22, in turn, bears against the wall of the bucket opposite the area where the bulk of the material climbs up inner surface as the bucket rotates. The drive rollers thus contact the wall of the bucket in the two areas where the maximum force bears against its inner surface, thereby stabilizing the bucket and ensuring high contact pressures/frictional engagement with the rollers. Moreover, the outward pressures against the wall of the bucket causes it to tend to bow outwardly on both sides of each roller in these areas, thus increasing the surface area that is in frictional contact with the drive rollers; for this reason, it is preferable to employ rollers having comparatively smaller rather than larger diameters, with a diameter of about 1¼-inches having been found eminently suitable.

Frictional engagement between the drive rollers and the bucket is further enhanced by resilient tubular sleeves 68. The sleeves are formed of a relatively soft, resilient material having a high coefficient of friction for engaging the slick outer surfaces of the plastic buckets, plus good wear and durability characteristics. Furthermore, the sleeves are preferably provided with a plurality of raised ribs or ridges, either annular or spiral, as opposed to having smooth, plain surfaces; the ribs/ridges form channels for passage of water/contaminant material on the exterior of the bucket while still maintaining frictional engagement between the ribs and the plastic surface. Moreover, because the particulate material (e.g., mortar or cement) is carried into the channels between the ribs/ridges together with the water, there is a reduced tendency for the particulate material (which is frequently abrasive in nature) to wear against or be pressed into the resilient material of the sleeves, thereby enhancing the longevity and effectiveness of the sleeves.

Fiberglass-reinforced irrigation suction hose has been found to provide a suitable ribbed, resilient sleeve material for use on the drive rollers of the present invention. In this material, the softer, high-friction plastic is supported in spiral ridges by a harder fiberglass material, giving an optimal combination of traction and durability. Moreover, the spiral configuration of the ridges acts in cooperation with the rotation of the rollers to draw the bucket outwardly towards its base, ensuring that the bucket remains firmly seated on the drive assembly during the mixing operation. 1¼-inch HD fiberglass-reinforced suction hose is suitable for use with drive rollers having the dimensions stated above.

When the bucket is seated on the drive assembly, the depending, generally cylindrical lower lip 70 at its lower end bears against the idler roller 32 on crossbar 34. The idler roller 32 thus supports and maintains the bucket in the proper longitudinal orientation on the drive rollers while creating minimal resistance to rotation. In the illustrated embodiment, the roller 32 is suitably a hardened steel roller that turns on a shaft 72 that is supported on brackets or otherwise mounted to the crossbar; it will be understood, however, that other forms of low friction structures and devices may be used to support the lip of the bucket, such as plastic (e.g., UHMWPE) rollers or blocks, for example.

As was noted above, the rollers 20, 22 are driven by chain from the motor 24. As can be seen in FIG. 3, the chain 26 engages driven sprockets 74, 76 on the ends of stub shafts that extend rearwardly from the leading and trailing rollers, and a drive sprocket 78 on the output shaft of motor 24. The drive and driven sprockets have relative diameters selected to produce the desired drive ratio: As can be seen in FIG. 3, the drive sprocket is sized larger than the driven sprockets so as to provide a ratio that steps up the speed of the drive rollers relative to that of the motor. Although the sprockets and chain are shown exposed in the drawings for ease of illustration, it will be understood that these components may be covered with a housing (e.g., formed of sheet metal, fiberglass or molded plastic) both for enhanced safety and reduced likelihood of damage from impacts and/or debris.

In the illustrated embodiment, a preferred drive motor for use in the assembly is a 12-volt DC automotive windshield-wiper motor. As a class, these motors have good torque characteristics and exhibit relatively low voltage draw. Moreover, they can be operated from the 12-volt electrical system of a stationary motor vehicle or from a comparatively small, rechargeable 12-volt battery (e.g., a trolling motor battery), thereby greatly enhancing portability of the assembly. As noted above, the drive and driven sprockets provide a ratio that increases the speed of the rollers from that of the motor, i.e., about 50 RPM. The drive chain 26 is suitably a conventional roller chain having a configuration matched to that of the drive and driven sprockets. It will be understood, however, that other forms of drive motors, such as 110 VAC electric motors, hydraulic motors, I/C engines and so on may also be used in some embodiments.

c. Mixer Basket

Figure 4:
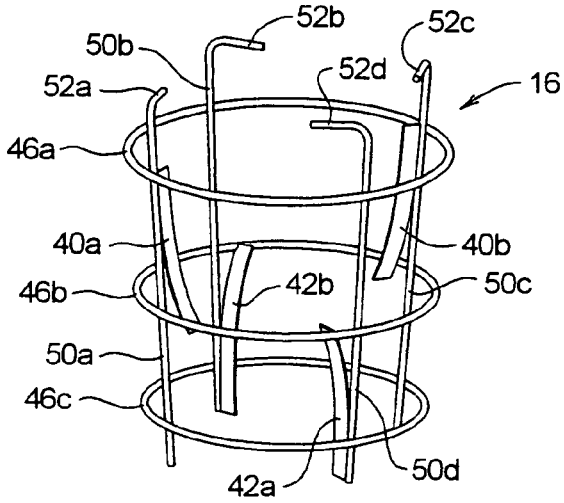
FIG. 4 is a perspective view of the multi-bladed mixer basket of the mixer assembly of FIG. 1, showing the structure of the mixer basket in greater detail.
Figure 5A:
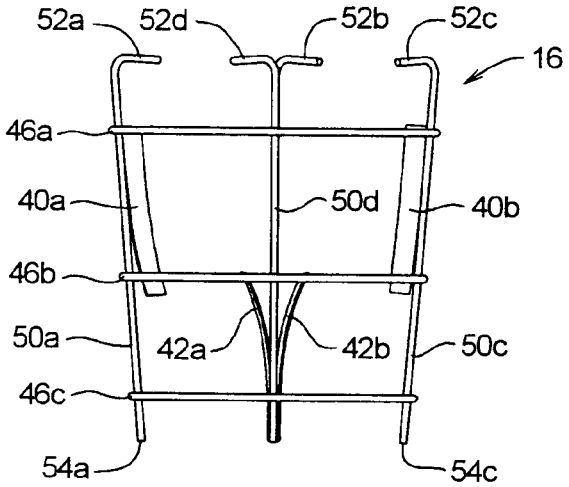
FIGS. 5A–5B are first and second side, elevational views of the mixer basket of FIG. 4, showing the relationship of the upper and lower blades of the basket and the associated support structure.
Figure 5B:
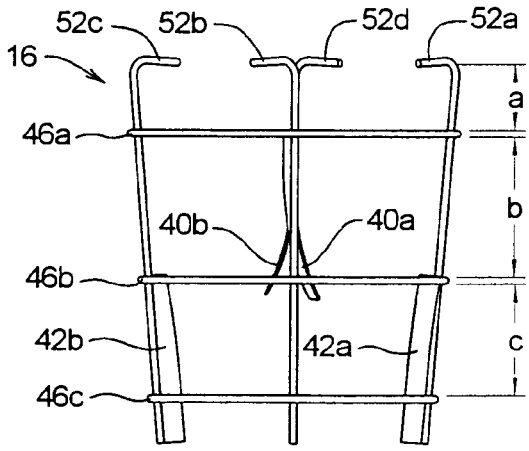
Figure 6:
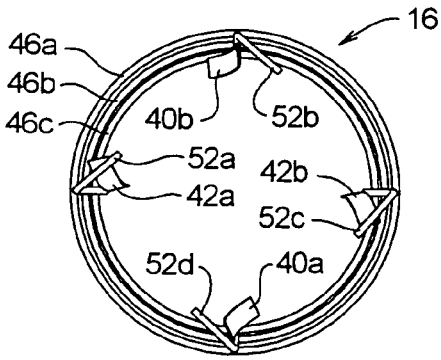
FIG. 6 is a top, plan view of the mixer basket of FIG. 4, showing the angularly spaced relationship of the blades thereof in greater detail.

The structure of the mixer basket assembly 16 is shown in greater detail in FIGS. 4–6.

As noted above, the basket assembly 14 includes blades 40*a*, 40*b* and 42*a*, 42*b* that are mounted in upper and lower pairs and project from the basket. It will be understood, however, that in other embodiments there may be more or fewer blades, mounted in pairs or otherwise.

As can be seen particularly in FIGS. 5A–5B, the lower ends of the upper blades 40*a*, 40*b* are curved in a direction towards the direction of rotation (counterclockwise when viewed from the top), while the upper ends of the lower blades are curved in the reverse direction. This both facilitates the mixing action and helps to ensure that the mixing basket is "pulled" downwardly into the mortar or other material that is being mixed.

Since the outside diameter of the basket assembly (i.e., the outside diameters of the wire rings 46*a*–*c*) is smaller by a predetermined amount than the inside diameter of the bucket at corresponding longitudinal locations, the basket is free to develop rotational motion relative to the latter; specifically, as the bucket is rotated the basket assembly rotates with the bucket but at a slightly slower speed. In the embodiment that is illustrated, the rings 46*a*–*c* define a taper that establishes a substantially constant ½-inch clearance (when centered) with the correspondingly tapered wall of the bucket.

As was also noted above, the rings are joined and supported by longitudinally extending wire rods 50*a*–*d*, so that the assembly is essentially in the form of a wire framework. The upper ends of the longitudinal rods are bent over (e.g., by about 90°) to form the handle portions 52*a*–*d* that facilitate insertion and removal of the basket assembly from the interior of the bucket, while the projecting lower ends form struts 54*a*–*d* that support the lowermost ring a spaced distance above the floor of the bucket and prevent the lower ends of the blades 42*a*–*b* from dragging thereon. Suitable spacings and heights for the rings and longitudinal rods are set forth in the following table, referring to FIG. 5B:

TABLE 1

| Dimension (inches) |
|---|
| a. 2.454 |
| b. 5.126 |
| c. 4.124 |
| d. 1.503 |

The foregoing dimensions are for an exemplary basket assembly of ¼-inch wire rod. It will be understood, however, that the dimensions and configuration of the basket assembly may vary in other embodiments.

It is preferable that at least the rings of the basket assembly have rounded outer faces where these bear against the inner surface of the bucket, e.g., the rings and rods may be formed of round wire rod. As part of the present invention, it has been found that the combination of the freely rotating basket assembly and the rounded outer surfaces of the rings and rods renders it far easier to remove the basket assembly from the bucket upon completion of mixing. By contrast, where flat-surfaced members are employed for the basket assembly (e.g., ring members having flat outer surfaces) it is often notably difficult to remove the basket assembly, in large part due to the tendency of rocks and other materials to jam between the basket assembly and the wall of the bucket during the mixing operation.

In the illustrated embodiment, the basket assembly is suitably constructed of welded steel wire, which is strong, highly durable and resistant to abrasion. In other embodiments, however, the basket assembly will be formed of other materials, such as injection-molded plastic, for example.

d. Collapsible Stand

Referring again to the drive assembly and the particular one shown in FIGS. 2–3, it will be seen that the primary support member of the drive assembly is a rectangular frame 80 constructed of elongate members 82*a*, 82*b* of a suitable material (e.g., ¾-inch square steel tubing), lying substantially in a common plane. The crossbar 34 is supported from the frame by a pair of upright members 84*a*, 84*b* and is stabilized against loads from the bucket by angled base members 86*a*, 86*b*. Left and right vertically extending channel sections 88*a*, 88*b* are mounted at the two forward corners of the frame 80. The channel sections are sized to receive the upper ends of first and second leg members 90*a*, 90*b*, and are pivotally connected thereto by pivot pins 92*a*, 92*b*. The legs are themselves joined to one another in parallel, spaced relationship by crossbar 94.

A third leg 96 is slidingly received in a sleeve 98 that is mounted to the frame bar 82*d* at the rear of the assembly. A cross member 100 is mounted to the rearward leg 96 so as to form a T-shaped handle at the top thereof. A bolt 104 having a T-handle for manual tightening/loosening extends through a threaded bore in the sleeve 98, with the end of the bolt bearing against and engaging the leg 96 so as to lock the latter in position. The forward-to-rearward angle of the mixer stand can be therefore be adjusted by loosening the locking bolt 104 and sliding leg 96 through sleeve 98 until the desired length projects below the frame 80.

Not only does this adjustment enable the assembly to accommodate irregularities in the ground, but more importantly, it allows the angle of the bucket to be adjusted for optimum mixing action, depending on both the properties and nature of the material being mixed. For example, if a larger quantity of more fluid material is being mixed then an increased, steeper angle may be desired, as opposed to a shallower angle when mixing a smaller amount of thicker, more cohesive material.

In order to collapse the drive assembly for transportation to another location, the locking bolt 104 is loosened and the rearward leg 96 is withdrawn upwardly from sleeve 98. The frame is then set on its rearward edge, resting on a rearward frame bar 82*d*, and the front legs 90*a*, 90*b* are pivoted downwardly and rearwardly until the crossbar 94 rests flat against the bottom of frame 80. The rear leg 96 is then inserted through first and second sleeves 106*a*, 106*b* that are mounted to frame 80 on extensions 108*a*, 108*b*, so that the leg 96 passes beneath cross bar 94 so as to hold the front legs in the folded position and prevent them from falling outwardly during transportation.

Thus collapsed, with its legs lying flat against the bottom of frame 80, the drive assembly is highly compact and easily transportable, as in the trunk of an automobile, for example. Moreover, the middle portion of the cross bar 34 provides a convenient and well-centered hand grip to aid in lifting and handling the assembly. As a result, the mixing apparatus of the present invention can be transported from one job site to the next with far greater ease than prior forms of mixers. Furthermore, in some embodiments one or more of the legs may be provided with wheels for aiding in moving the apparatus about when it has been set up.

e. Operation

Figure 7:
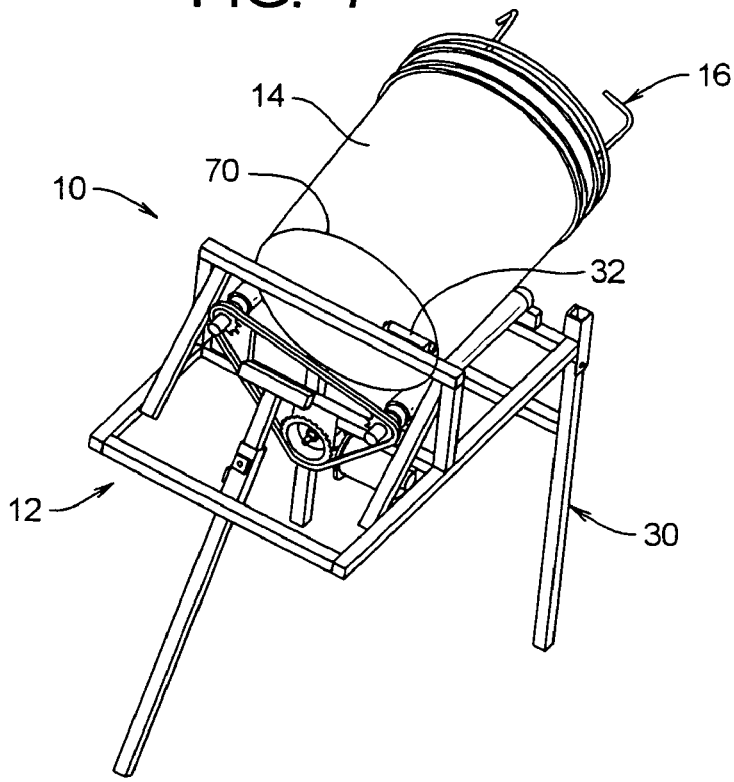
FIG. 7 is a rear elevational view, similar to FIG. 3, showing the manner in which the drive rollers engage and rotate the bucket when the latter is set thereon.
Figure 8:
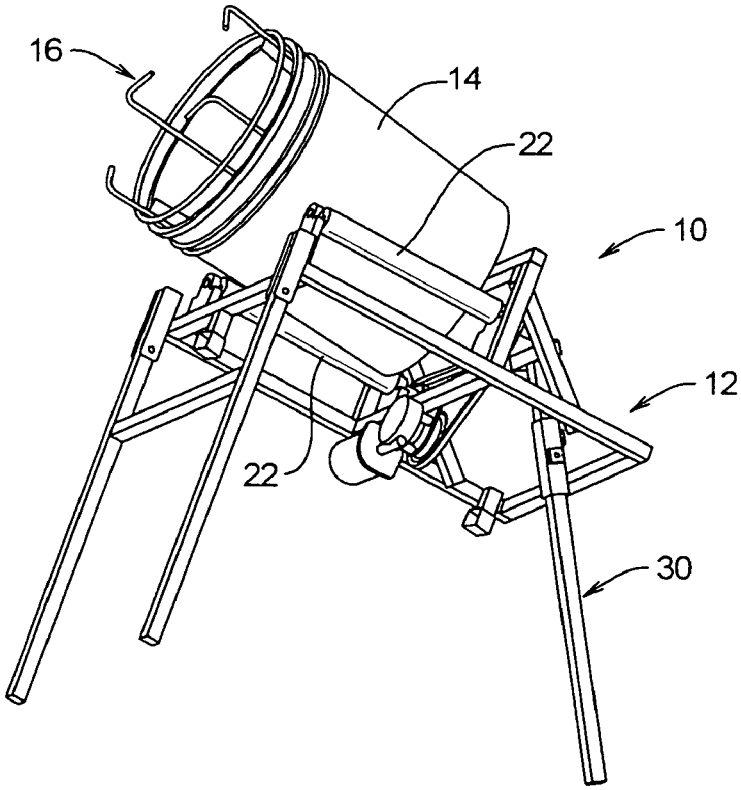
FIG. 8 is a front, perspective view of the mixer assembly and bucket of FIG. 7, showing the relationship between the drive rollers and the side of the bucket in further detail.

In order to use the apparatus of the present invention, the operator simply places the desired amount of mortar, grout, plaster or other material in the bucket 14 and then places the basket assembly 16 therein, using the handle portions 52*a*–*d* described above. The bucket and mixing basket are then placed on the drive rollers as shown in FIGS. 7–8, and the drive motor is energized. If the bucket has a bale, this can be secured using a clip (not shown) so that the bale does not flop about as the bucket is rotated. As noted above, the drive assembly of the illustrated embodiment rotates the bucket assembly at about 50 RPM, which is suitable and effective for mixing these and similar types of materials.

When the desired amount of mixing has been achieved, the operator simply lifts the bucket off of the drive assembly and sets it upright. The mixing basket 16 is withdrawn and placed in a second bucket (not shown) that has been filled with the next batch of material. The operator carries the first bucket (using the bale, if so equipped) to the site at which the material is applied, while the apparatus continues to prepare the next batch without requiring any intervention from the operator. When application of the first batch of material has been completed, the operator simply carries the bucket back to the mixing apparatus, removes the second bucket from the drive rollers, and repeats the process using the same or subsequent plastic buckets. In this manner the mixing is accomplished in an extremely efficient manner, with little or no wasted time between batches.

When the job has been completed, the mixing basket 16 is simply hosed off, and the buckets can also be rinsed out and cleaned very quickly due to the relatively low adhesion of the plastic material. If any of the buckets have become damaged or worn to an excessive amount they can be discarded and replaced with others at little or no cost. The drive assembly 12 is likewise easy to clean by simply hosing it off. The drive assembly is then rapidly collapsed into a compact package, as described above, ready to be transported to the next job site.

It is to be recognized that various alterations, modifications, and/or additions may be introduced into the constructions and arrangements of parts described above without departing from the spirit or ambit of the present invention.

What is claimed is:

1. A portable apparatus for mixing material in disposable plastic buckets, said apparatus comprising:

(a) a drive assembly comprising:

(i) first and second generally parallel drive rollers that are spaced apart so as to form a cradle area for receiving a sidewall of a disposable plastic bucket therein, and (ii) a means for rotating at least one of the drive rollers so as to rotate the plastic bucket when the bucket is in engagement therewith; and (b) a mixing basket for being placed within the interior of the plastic bucket, the mixing basket being free from attachment from the plastic bucket and having at least one mixing blade projecting from the basket for agitating the material in the plastic bucket as the bucket is rotated by the drive rollers.

2. The apparatus of claim 1, wherein said drive assembly comprises:

means for rotating both said first and second drive rollers.

3. The apparatus of claim 2, wherein said means for rotating said first and second drive rollers comprises:

a motor; and power transmission means operatively interconnecting said motor and drive rollers.

4. The apparatus of claim 3, wherein said power transmission means comprises:

a drive chain that is in operative engagement with a drive socket on an output shaft of said motor and driven sprockets on said first and second drive rollers.

5. The apparatus of claim 2, wherein said drive assembly comprises:

a means for supporting the first and second drive rollers in a downwardly and rearwardly sloping angle, so that said plastic bucket is supported at an angle which slopes towards a closed lower end of said bucket when resting on said rollers.

6. The apparatus of claim 5, further comprising:

means for engaging and supporting a peripheral lip around a bottom of said plastic bucket so as to maintain said bucket at said sloping angle in a predetermined longitudinal position on said rollers.

7. The apparatus of claim 6, wherein said means for engaging and supporting said peripheral lip around said bottom of said plastic bucket comprises:

an idler roller that engages said peripheral lip when said bucket is placed in said receiving tree on sail drive rollers.

8. The apparatus of claim 7, wherein the means for supporting said first and second rollers in a downwardly and rearwardly sloping angle comprises:

a frame having at least forward and rearward legs mounted thereto, said forward leg being relatively longer than said rearward leg so that said frame is supported at said downwardly and rearwardly sloping angle.

9. The apparatus of claim 5, wherein said first drive roller is a leading drive roller and said second drive roller is a trailing drive roller, and wherein said leading drive roller is positioned relatively lower than said trailing drive roller so that said leading drive roller bears against an area of said sidewall that during rotation of said bucket is subject to outward and downward pressure from said material that is mixed therein.

10. The apparatus of claim 9, wherein said leading and trailing drive rollers are angled together towards rearward ends thereof, so that said rollers extend at a relative angle that matches a predetermined taper of said sidewall of said plastic bucket.

11. The apparatus of claim 5, wherein said first and second drive rollers each comprises:

external non-slip surfaces for frictionally engaging said sidewall of said plastic bucket in drive relationship therewith.

12. The apparatus of claim 11, wherein said non-slip surfaces comprise:

resiliently compressible sleeves mounted externally on first and second drive rollers.

13. The apparatus of claim 12, wherein said resiliently compressible sleeves comprise:

a plurality of raised ridges for engaging said sidewall of said plastic bucket, with channels being formed between said ridges for receiving water and debris as said bucket is rotated in contact therewith.

14. The apparatus of claim 13, wherein said ridges and channels on said resiliently compressible sleeves have a spiral configurations that cooperate with said exterior of said plastic bucket so as to draw said bucket downwardly in response to rotation of said bucket on said rollers.

15. The apparatus of claim 1, wherein said basket assembly comprises:

an open framework having a plurality of blade members mounted thereto.

16. The apparatus of claim 15, wherein said blade members comprise:

upper and lower blade members that are mounted to said framework in diametrically opposed pairs.

17. The apparatus of claim 16, wherein said blade members are mounted to said framework so as to extend in a longitudinal direction generally parallel to a long axis of said bucket.

18. The apparatus of claim 17, wherein said blade members comprise lower end portions that bend in a direction in which said plastic bucket is rotated by said drive rollers.

19. The apparatus of claim 18, wherein said framework of said basket assembly comprises:

a plurality of rings having said blade members mounted internally thereto, said rings being progressively smaller from top to bottom so as to define a taper that corresponds to a predetermined taper of said sidewall of said bucket.

20. The apparatus of claim 19, wherein said rings of said basket assembly are sized to form an annular gap of about ½ inch with said sidewall of said bucket when centered therein.

21. The apparatus of claim 19, wherein said framework of said basket assembly further comprises:

a plurality of rods mounted to said rings so as to extend in a longitudinal direction generally parallel to an axis of said bucket.

22. The apparatus of claim 21, wherein said rods of said framework comprise:

upper ends that are bent over so as to form handle portions for manually lifting said basket assembly from said bucket.

23. The apparatus of claim 22, wherein said rods of said framework further comprise:

downwardly extending strut portions that project below a lower-most said ring so as to support a bottom end of said framework a spaced distance above a floor of said bucket.

24. The apparatus of claim 23, wherein said rings and rods of said basket assembly are constructed of a welded metal rod.

* * * * *